United States Patent [19]

Ninet

[11] 4,413,926

[45] Nov. 8, 1983

[54] SYSTEM AND METHOD FOR POSITIONING AN OFF-SHORE PLATFORM ON A SUPPORT

[75] Inventor: Jean-Louis Ninet, Nantes, France

[73] Assignee: Societe Anonyme dite: Ateliers et Chantiers de Bretagne-ACB, Nantes, France

[21] Appl. No.: 290,537

[22] Filed: Aug. 6, 1981

[30] Foreign Application Priority Data

May 15, 1981 [FR] France ..... 81 09708

[51] Int. Cl.[3] ..... E02D 25/00

[52] U.S. Cl. ..... 405/204; 405/195; 405/203

[58] Field of Search ..... 405/195–199, 405/203–208, 224; 114/264, 265; 175/5–7

[56] References Cited

U.S. PATENT DOCUMENTS

| | | | |
|---|---|---|---|
| 3,736,756 | 6/1973 | Lloyd | 405/204 |
| 4,090,367 | 5/1978 | Verschure | 405/195 |
| 4,161,376 | 7/1979 | Armstrong | 405/204 X |
| 4,199,276 | 4/1980 | Molsberger | 405/198 |
| 4,252,469 | 2/1981 | Blight et al. | 405/204 |

*Primary Examiner*—Dennis L. Taylor

*Attorney, Agent, or Firm*—Sughrue, Mion, Zinn, Macpeak and Seas

[57] ABSTRACT

An off-shore platform (1) is floated on a barge (2). A support structure is fixed to the sea bed and including a plurality of upstanding piles with at least two of said piles (4) having platform-receiving guide means (5) at their upper ends. The platform includes a plurality of legs for fixing to corresponding ones of the piles with at least two of the legs (6) being hollow and being provided with respective plungers (8) slideably mounted therein for co-operating with said platform-receiving guide means. Each plunger is associated with a releasable fastening (10, 11) capable of holding the plunger fixed in its leg, and of releasing it suddenly on command to drop into engagement with said platform-receiving guide means. The releasable fastenings of at least two of the plungers are arranged to release simultaneously on a common command.

6 Claims, 10 Drawing Figures

AG0
h d'
H
h
AG0

SYSTEM AND METHOD FOR POSITIONING AN OFF-SHORE PLATFORM ON A SUPPORT

The present invention relates to any off-shore platform that is to be mounted on a pre-installed support structure fixed to the sea bed. The platform is floated out to the support on a barge, and consequently the swell hinders marrying the platform to the support.

BACKGROUND TO THE INVENTION

Such a platform has legs which, at the end of the operation must engage predetermined parts of the support structure. These parts are usually piles projecting above the surface of the water, and the legs are generally made fast thereto by welding.

In waters that are protected from swell, such an operation is performed relatively easily by simply ballasting the barge.

At sea, one of the major difficulties arises from the fact that swell applies a horizontal back-and-forth motion to any floating body relative to the sea bed, in addition to the more obvious up-and-down motion. However, to connect the platform to its support structure it is necessary for all the corresponding legs and piles to be in coincidence.

Swell is not entirely uniform, and generally comprises series of waves interspersed with periods of relative calm. It is thus essential to be able to fix the horizontal position and orientation of the platform during the time allowed by such periods of relative calm. In most seas such periods last for less than one minute.

One conventional solution is to suspend the platform from a barge-mounted crane, and to let it drop suddenly at a moment when the legs and the piles coincide. Crane operators are capable of reacting quickly enough to perform such a manoeuver.

This type of solution requires exceedingly heavy equipment for platforms that weigh more than about one thousand tons.

The aim of the present invention is to provide a cheaper system capabale of providing quasi-instantaneous connection between the legs of a platform and the tops of piles intended to receive said legs.

SUMMARY OF THE INVENTION

The present invention provides a system for positioning a barge-mounted off-shore platform on a support structure fixed to the sea bed, said fixed support structure including a plurality of upstanding piles with at least two of said piles having platform-receiving guide means at their upper ends, and said platform including a plurality of legs for fixing to corresponding ones of said piles with at least two of said legs being hollow and being provided with respective plungers slideably mounted therein for co-operating with said platform-receiving guide means, wherein each plunger is associated with a releasable fastening capable of holding the plunger fixed in its leg, and of releasing it suddenly on command to drop into engagement with said platform-receiving guide means, the releasable fastenings of at least two of the plungers being arranged to release simultaneously on a common command.

Preferably, each said releasable fastening includes at least one finger passing through the leg and through a bore in the plunger.

The present invention also provides a method of positioning a barge-mounted platform on a support structure fixed to the sea bed, using the above-defined system, said method comprising the following steps:

(a) the barge on which the platform is mounted is moved into a position such that the legs are vertically above the corresponding piles;

(b) at least two of said releasable fastenings are released simultaneously to cause at least two plungers to engage the corresponding guide means, thereby fixing the horizontal position and orientation of the platform;

(c) remaining plungers, if any, are released to engage corresponding piles;

(d) the barge is ballasted until it ceases to support the platform, and is then moved away from the platform; and (e) each leg is made fast with its corresponding pile.

Preferably each of said hollow legs includes at least one pair of openings for receiving a plunger-restraining bolt to restrict the travel of the plunger, and said method then includes a further step between steps (c) and (d), during which further step and plunger-restraining bolts are inserted in said legs.

BRIEF DESCRIPTION OF THE DRAWINGS

Two embodiments of the invention are described by way of example with reference to the accompanying drawings, in which.

DESCRIPTION OF PREFERRED EMBODIMENTS

Figures 1A, 1B, 1C, 1D, 1E:
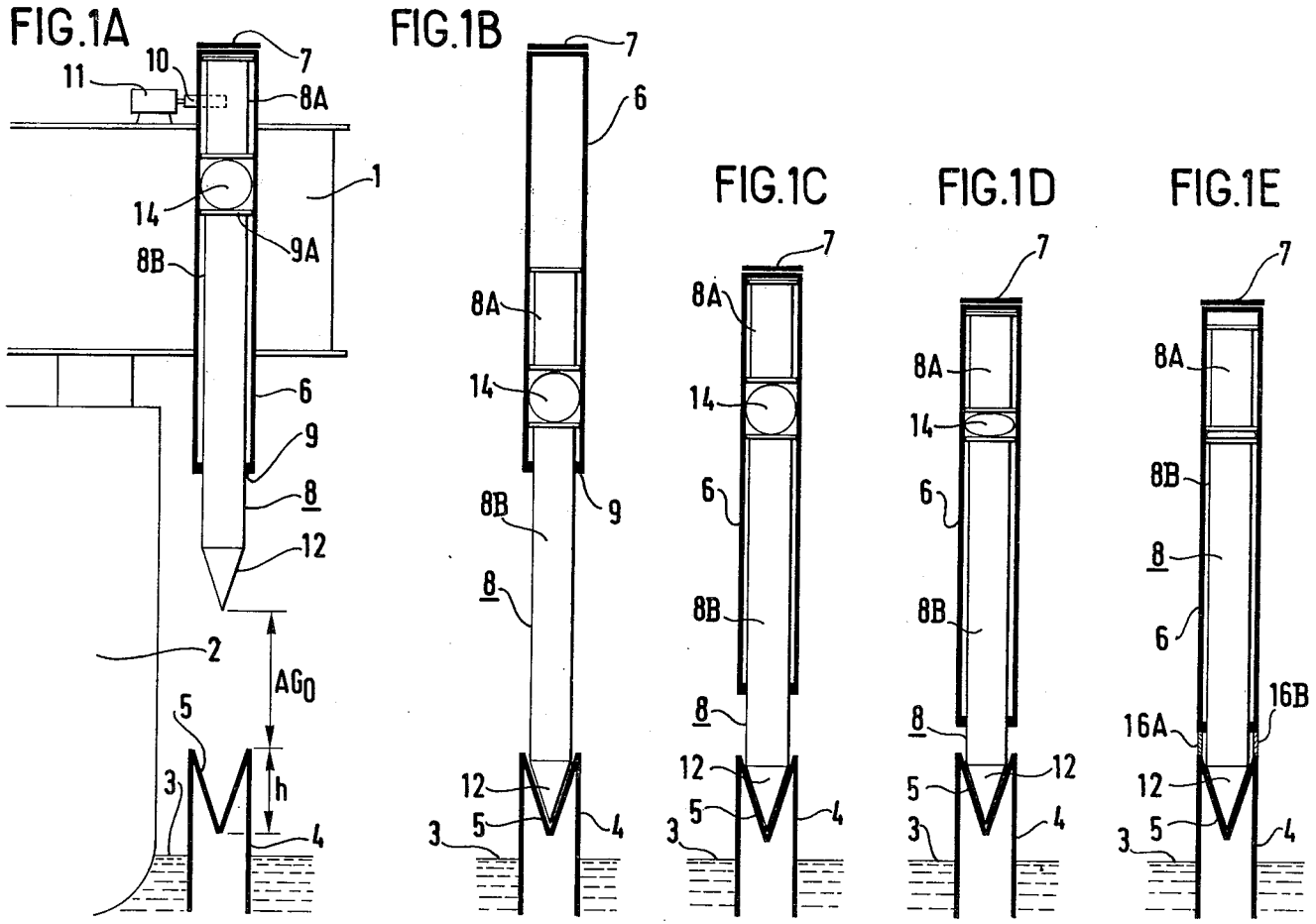
FIGS. 1A to 1E are schematic sectional views comprising a sequence of diagrams showing a first embodiment.

In FIG. 1A, a platform 1 is carried by a transport barge 2. A support structure for receiving the platform is fixed to the bed of the sea 3. The structure has piles whose tops project above the surface of the water. One such pile, referenced 4, is shown in the Figures. At its upper end there is a platform-receiving guide means in the form of a female cone 5.

The platform 1 has a leg 6 corresponding to each pile. For example, a platform might have four legs to be made fast with four piles.

At least two of the legs 6 are constituted by hollow cylinders that are closed at their upper ends by a bar or stop 7. The leg shown in the Figures is of this hollow type.

A plunger 8 is disposed inside the tube of each hollow leg. The plunger 8 has the following characteristics:

It is slidably mounted therein, and its movement is guided by means such as an inwardly turned rim 9 at the lower end of the tube, and an outwardly extending head 9A at the top of the plunger.

It is held fast against the stop 7 at the top of the tube by a releasable fastening such as a mechanical finger 10 which passes through an appropriate opening in the tube and is engaged in a bore in the plunger. The finger can be removed therefrom by a jack 11. Alternatively, there may be a plurality of simultaneously removable fingers.

Its lower end is in the shape of a cone 12 to facilitate engaging the conical guide means or guide cone 5 at the upper end of the pile 4.

Its lower end projects from the bottom of the tube.

It is constituted by two axially aligned tubes 8A and 8B which sandwich a shock-absorbing block of elastomer 14.

The system operates as follows:

During transport the plungers 8 are retracted inside their respective legs 6, with the head of each plunger engaged against its end stop 7.

The transport barge is positioned by means of anchor lines with the legs high enough above the tops of the piles to avoid accidental collision therebetween.

At the moment the barge is positioned the clearance between the bottoms of the legs and the tops of the piles depends on numerous factors, including the state of the tide, the wave-induced up-and-down movement of the barge, and safety factors. The average value of this clearance is designated $AG_0$.

When held in place by means of the anchor lines, the barge and platform assembly oscillates about an average position, due to the swell. The anchor lines are adjusted so that the average position is one in which the legs and the pile coincide.

The barge is then ballasted so that the clearance $AG_0$ is reduced to the minimum value compatible with the up-and-down movement of the barge and platform assembly and the need to avoid premature collisions between legs and piles. This is the position shown in FIG. 1A.

Vertical coincidence can be maintained for about one minute during a lull in the swell. It is during such a lull that at least two of the plungers 10 are simultaneously released so that they drop into the receiver cones at the tops of the corresponding piles. Simultaneous release is obtained by giving a common command to act on the corresponding jacks 11 simultaneously. Two plungers are sufficient, geometrically-speaking, to fix the horizontal position and orientation of the platform. However, for reasons of strength and reliability it may be preferable, or even necessary to release more than two plungers simultaneously. They may all be released together. In any event one plunger is insufficient since it cannot prevent the platform from rotating about the one pile with which contact would then be made.

After the plungers have been dropped (FIG. 1B), the barge and platform assembly can still move vertically under the influence of the swell, with the plungers sliding up and down inside their hollow legs. As a safety precaution the height of the mating cones should be chosen to be greater than the maximum vertical travel expected during conditions favourable for placing the platform on the support. This is to avoid the possibility of friction jamming a plunger long enough for it to be lifted out of the corresponding pile.

Advantageously, the platform-receiving guide cone 5 can be mounted on its pile 4 via a resilient shock absorber to absorb the impact of the plunger dropping into the cone, thereby reducing the danger of damaging the piles, particularly in the event that the platform is somewhat off-center when the plungers are dropped.

The platform is then lowered onto the support structure by ballasting the barge until the end stops 7 of the platform legs again come into contact with the heads of the plungers 8. The relative position between leg and plunger is thus back to the initial position, see FIG. 10.

As the barge is ballasted, its vertical movement causes bumping between the end stops 7 and the plungers 8. This bumping is damped by the shock absorbers 14.

Finally the barge sinks far enough for the platform to rest entirely on the piles, with the shock absorbers being squashed in the process, see FIG. 1D.

Plunger length and end stop position inside the legs are so chosen that at the end of the operation, the bottoms of the legs 6 are close enough to the tops of the piles 4 for them to be welded together, using pairs of half tubular shells 16A and 16B where necessary, to ensure continuity of the piles and the legs in the final structure.

The shock absorber may then be destroyed, e.g. by chemical action, see FIG. 1E.

The ballasting depth, i.e. the distance the barge must be capable of being lowered by ballasting to perform the above operation, is equal to the sum of at least the following four terms:

(1) the depth D by which the weight of the platform lowers it in the water;

(2) the initial clearance $AG_0$;

(3) the half amplitude H of wave-induced up-and-down movement; and (4) the height h of the female cone 5. ($h=2H$).

For a platform weighing 6000 tons mounted on a 120 m×30 m barge, the depth D is about 2 meters. If the initial clearance $AG_0$ is 0.6 m and the half amplitude H is 0.45 m, then the ballasting depth is about 4 m. Ballasting under these conditions requires a very great deal of water, say about 13,000 tons.

A variant of the system enables the ballasting depth to be reduced. The variant is thus particularly applicable to very large platforms.

The variant is based on the following considerations:

Immediately after the plungers have been dropped, the distance between the end stops 7 and the heads of the plungers 6 becomes $AG_0+h\pm H$.

Inserting a block of total height $AG_0+h-H$ between the top of the plunger and the end stop would then reduce the ballasting depth by that amount.

Using the figures from the above worked example, there would be a gain of $0.6+0.9-0.45=1.05$ meters, which is about one fourth of the ballasting depth.

FIGS. 2A to 2E show a variant of the system that implements such a technique.

The leg shown in these Figures is provided with pairs of openings 20A and 20B, and 21A and 21B. The openings are intended to receive a plunger-restraining bolt 19, and the lower edge of the lower pair of openings is at a maximum distance from the end stop 7 such that the distance between the end stop 7 and the bottom of the bolt 19 is equal to d' where $d'=AG_0+h-H$.

Figures 2A, 2B, 2C, 2D, 2E:
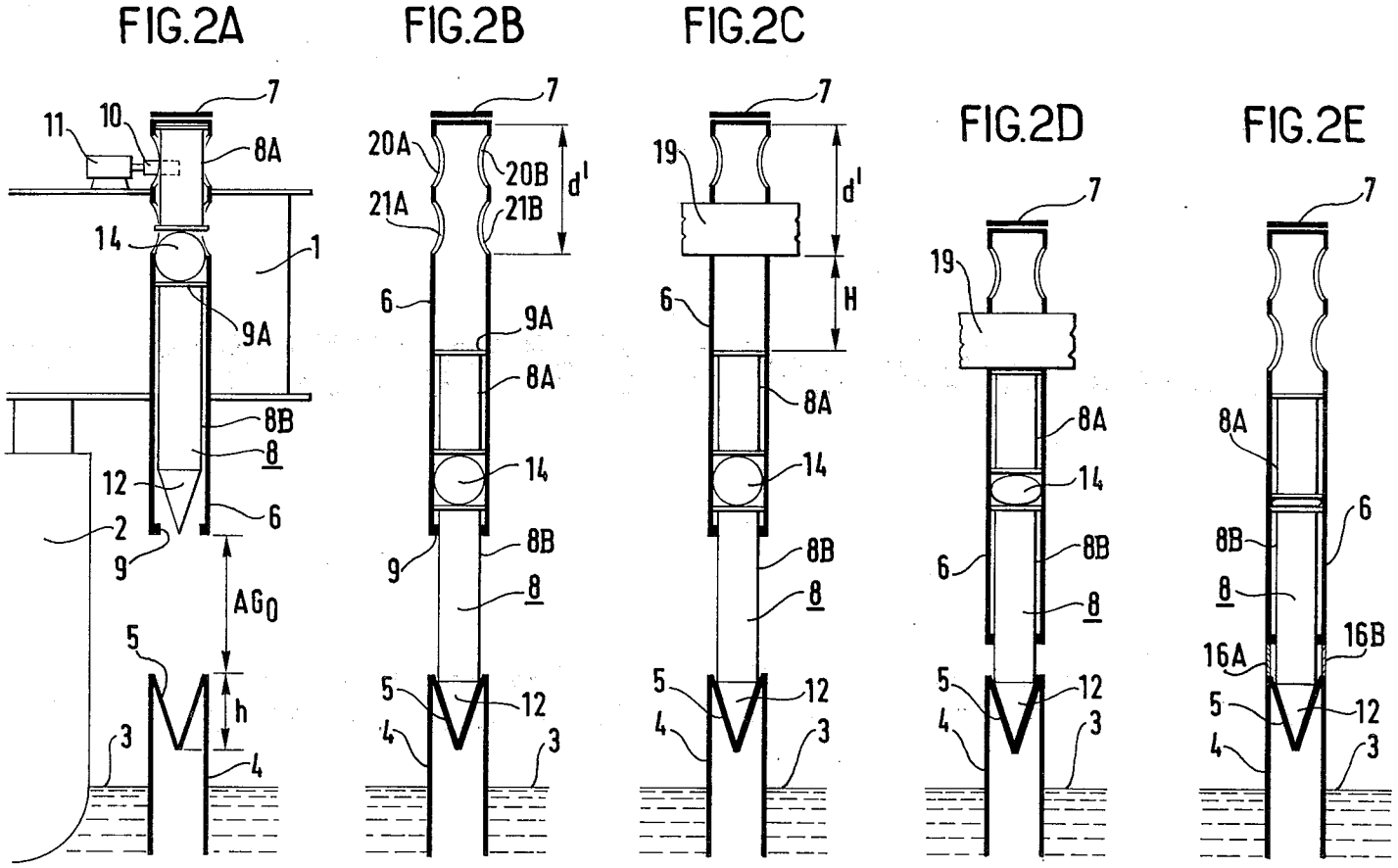
FIGS. 2A to 2E are schematic sectional views comprising a similar sequence of diagrams showing a second embodiment.

As shown in FIG. 2C which shows the system at the beginning of ballasting, the bolt 19 is inserted in the leg via one pair of openings (in this case the lower pair 21A and 21B) so that it acts as an end stop for the plunger 8.

The most suitable pair of orifices depends on factors such as the state of the tide and of the waves, and is therefore chosen as a function of conditions prevailing during the operation.

FIG. 2E shows the final position of the various members after the half-shells 16A and 16B have been welded and the shock absorber 14 has been destroyed.

The bolt 19 is mounted on a slide (not shown) which passes through the leg 6, but which is disposed outside the path of the plunger 8, e.g. two rails that pass on either side of the plunger. The slide extends beyond the leg and the bolt is mounted thereon in a waiting position ready for use.

The bolt may be slid manually into the leg using a mechanical aid such as a lever (not shown) which is only required to supply enough force to overcome friction between the bolt and the slide.

A further advantage of the variant shown in FIGS. 2A to 2E lies in the fact that the moment of the horizontal forces due to the swell on the plungers is reduced. This follows from the reduced ballasting depth requiring shorter plungers, and can clearly be seen by comparing FIGS. 1B and 2B. Under favourable conditions this reduction in length and corresponding lever arm may be as much as 1.5 meters.

I claim:

1. System for positioning a barge-mounted off-shore platform on a support structure fixed to the sea bed, said fixed support structure including a plurality of upstanding piles with at least two of said piles having platform leg-receiving guide means at their upper ends, said platform including a plurality of legs for fixing to corresponding ones of said piles, at least two of said legs being hollow, plungers slideably mounted within said hollow legs for co-operating engagement with said platform leg-receiving guide means, a releasable fastening holding the plunger fixed at a raised position within said hollow leg for releasing said plunger on command for gravity drop into engagement with said platform leg-receiving guide means, means for effecting release simultaneously on a common command of the releasable fastenings of at least two of the plungers, abutment means fixedly mounted to said legs above said plungers for limiting upward movement of said plunger within said hollow leg, and wherein each plunger is constituted by upper and lower, axially separated rigid members freely slidable within said hollow leg with a block of shock-absorbing material sandwiched in between them, and wherein said lower rigid member terminates in a lower end configured to said platform leg-receiving guide means; whereby, upon release of said releasable fastening, said upper and lower rigid members with the block of shock-absorbing material sandwiched in between them move downwardly within said hollow leg until said lower rigid members abut said piles with the lower ends received within said guide means, and wherein as said platform continues to descend, said rigid members and said block of shock-absorbing material move upwardly within said hollow legs, until said upper rigid member abuts said abutment means, whereupon said lower rigid members continue to move relative to the hollow legs to the extent where said block of shock-absorbing material sandwiched in between said upper and lower rigid members, is fully compressed.

2. The system as claimed in claim 1, wherein the length of each hollow leg from said abutment means, the length of the axially-separated rigid members and said block of shock absorbing material for each plunger which is sandwiched in between said rigid members, is such that in the abutment position with the shock-absorber fully compressed under the weight of the platform, there is a small space between the bottom of leg 6 and the top of pile 4, and wherein said legs are made fast with said piles by welding them to said piles at said small space.

3. A method of positioning a barge-mounted off-shore platform on a support structure fixed to the sea bed, said fixed support structure including a plurality of upstanding piles with at least two of said piles having platform leg-receiving guide means at their upper ends, said platform including a plurality of legs for fixing to corresponding ones of said piles, at least two of said legs being hollow and being provided with respective plungers slidably mounted therein for cooperating engagement with the platform leg-receiving guide means, a releasable fastening for holding each plunger fixed in its leg and for sudden release for gravity drop of the plunger into engagement with the platform leg-receiving guide means, and wherein a block of shock-absorbing material is positioned within each hollow leg and between the ends of the plungers remote from said platform leg-receiving guide means of said piles and abutment means carried by said hollow legs above said plungers and said block of shock-absorbing material, said method comprising the following steps:

(a) moving the barge on which the platform is mounted into a position such that the legs are vertically above the corresponding piles;

(b) releasing at least two of said releasable fastenings simultaneously to cause said at least two plungers to engage the corresponding guide means, thereby fixing the horizontal position and orientation of the platform;

(c) releasing the remaining plungers, if any, to engage corresponding piles;

(d) ballasting the barge until it ceases to support the platform, and causing the shock absorber to be compressed under the weight of the platform, and wherein the length of the plunger and the length of the shock absorber block is such that in the abutment position with the shock absorber being compressed under the weight of the platform, there is a small space between the bottom of the leg and the top of the pile, and wherein said method further comprising the steps of moving the barge away from the platform; and (e) fastening each leg with its corresponding pile at said small space between the bottom of the leg and the top of the pile subsequent to full compression of said shock absorber block.

4. A method according to claim 3 wherein each of said hollow legs includes at least one pair of openings for receiving a plunger-restraining bolt to restrict the travel of the plunger, and wherein said method includes a further step between steps (c) and (d), of inserting said plunger-restraining bolts in said legs.

5. A method according to claim 2 wherein each plunger is constituted by two axially-separated rigid members freely slidable within said hollow legs, and wherein said block of shock-absorbing material is sandwiched in between them, and wherein said method further comprises the step of destroying the block after said leg is made fast with its corresponding pile.

6. A method according to claim 3 wherein the legs are made fast in step (e) by welding them to the piles, and wherein a distance piece in the form of a pair of half tubular shells is added to surround any portion of plunger that remains visible, thereby ensuring un-interrupted tubular connection between the corresponding leg and pile.

* * * * *